US009567141B2

(12) United States Patent
Schneider et al.

(10) Patent No.: US 9,567,141 B2
(45) Date of Patent: Feb. 14, 2017

(54) CONTAINER WITH A CHILD-PROOF LOCK

(71) Applicant: Sanner GmbH, Bensheim (DE)

(72) Inventors: Matthias Schneider, Heidesheim (DE); Kai Tiesberger, Sandhausen (DE)

(73) Assignee: Sanner GmbH, Bensheim (DE)

( * ) Notice: Subject to any disclaimer, the term of this patent is extended or adjusted under 35 U.S.C. 154(b) by 0 days.

(21) Appl. No.: 15/026,875

(22) PCT Filed: Sep. 30, 2014

(86) PCT No.: PCT/EP2014/070908
§ 371 (c)(1),
(2) Date: Apr. 1, 2016

(87) PCT Pub. No.: WO2015/049226
PCT Pub. Date: Apr. 9, 2015

(65) Prior Publication Data

US 2016/0311587 A1 Oct. 27, 2016

(30) Foreign Application Priority Data

Oct. 2, 2013 (DE) ..... 10 2013 110 997

(51) Int. Cl.
*B65D 45/28* (2006.01)
*B65D 50/04* (2006.01)
(Continued)

(52) U.S. Cl.
CPC ..... *B65D 50/045* (2013.01); *B65D 45/28* (2013.01); *B65D 47/0804* (2013.01);
(Continued)

(58) Field of Classification Search
CPC ..... B65D 50/045; B65D 45/28; B65D 51/30; B65D 47/0804; B65D 83/04; B65D 2251/1025; B65D 2215/02; B65D 50/046; B65D 50/22; B65D 50/20; B65D 50/16; B65D 50/18; B65D 43/26; B65D 47/0809; B65D 47/08; B65D 83/0418; B65D 83/0409
(Continued)

(56) References Cited

U.S. PATENT DOCUMENTS 4,244,495 A 1/1981 Lorscheid et al.
4,538,731 A * 9/1985 Cillario ..... B65D 47/0847 206/540
(Continued)

FOREIGN PATENT DOCUMENTS

DE 28 28 065 A1 1/1980
DE 32 19 051 A1 4/1983
(Continued)

OTHER PUBLICATIONS

English language abstract not found; however, a machine-assisted English language translation for DE 2 219 051 A1 was extracted from www.espacenet.com on Mar. 30, 2016; 8 pages.
(Continued)

*Primary Examiner* — Robert J Hicks
*Assistant Examiner* — Kareen Thomas
(74) *Attorney, Agent, or Firm* — Howard & Howard Attorneys PLLC

(57) ABSTRACT

A container having a container body (2) comprises a container wall (3) and forms a receiving space (4) for goods to be packaged (5). The container comprises a discharge opening (6) for discharging the goods to be packaged (5) and a container closure (10) for closing the discharge opening (6). The container closure (10) comprises a lid (12) which can assume a closed position for closing the discharge opening (6) and an open position for opening the discharge opening (6). The container further comprises a child-proof lock (30) including first and second locking elements (18, 19). The
(Continued)

first and second locking elements (18, 19) can assume a mutual locked position in which the lid (12) is fixed in the closed position, and wherein the first and second locking elements (18, 19) can be moved to a release position in which the lid (12) can be moved to the open position.

20 Claims, 5 Drawing Sheets

(51) Int. Cl.
*B65D 83/04* (2006.01)
*B65D 51/30* (2006.01)
*B65D 47/08* (2006.01)

(52) U.S. Cl.
CPC ..... *B65D 51/30* (2013.01); *B65D 83/04* (2013.01); *B65D 2215/02* (2013.01); *B65D 2251/1025* (2013.01)

(58) Field of Classification Search
USPC ..... 220/315, 323, 324, 810, 212,220/254.3–254.9, 260, 264, 263, 262, 326; 215/287, 290, 284, 280, 273, 215, 201; 206/535, 536
See application file for complete search history.

(56) References Cited

U.S. PATENT DOCUMENTS 4,795,056 A * 1/1989 Meyers ..... B65D 50/045 215/321
5,575,399 A * 11/1996 Intini ..... B65D 21/0233 220/835
5,577,779 A * 11/1996 Dangel ..... E05C 19/06 220/326
5,979,691 A * 11/1999 Von Holdt ..... B65D 43/0256 220/266
7,413,479 B1 * 8/2008 Volpone ..... H01R 13/506 174/138 F
8,807,359 B2 8/2014 Giraud et al.
9,150,339 B2 10/2015 Giraud et al.
2003/0201283 A1 10/2003 Branson et al.
2007/0170185 A1 7/2007 Hanssen et al.
2008/0217337 A1 * 9/2008 Rault ..... B65D 43/165 220/266
2010/0140283 A1 6/2010 Brozell
2011/0259889 A1 * 10/2011 Yang ..... A47J 45/062 220/315
2015/0175322 A1 6/2015 Goettke et al.
2016/0016698 A1 1/2016 Giraud et al.

FOREIGN PATENT DOCUMENTS

DE 20 2012 101254 U1 7/2012
GB 2 082 552 A 3/1982
WO WO 2005 090187 A1 9/2005
WO WO 2007 109166 A2 9/2007
WO WO 2010 068548 A1 6/2010
WO WO 2011 026934 A1 3/2011

OTHER PUBLICATIONS

German National Search Report dated May 21, 2014 for German Application No. DE 10 2013 110 997.7; 7 pages.
International Search Report (Translated) dated Dec. 8, 2014 for PCT Application No. PCT/EP2014/070908; 3 pages.
Written Opinion dated Dec. 8, 2014 for PCT Application No. PCT/EP2014/070908; 6 pages.

* cited by examiner

CONTAINER WITH A CHILD-PROOF LOCK

RELATED APPLICATIONS

This application is the National Stage of International Patent Application No. PCT/EP2014/070908, filed Sep. 30, 2014, which claims priority to and all the advantages of German Patent Application No. DE 10 2013 110 997.7, filed on Oct. 2, 2013, the entire contents of which are hereby incorporated by reference.

TECHNICAL FIELD

The invention relates to a container having a child-proof lock for medicinal products, such as tablets, or other goods to be packaged in a particularly child-proof manner.

BACKGROUND OF THE DISCLOSURE

DE 28 28 065 A1 describes a synthetic material lid closure for containers. The closure comprises a lock member, which can be unlocked by pressing onto the deformable outer wall of the lid support.

A further container with a child-proof lock is known from US 2003/0201283 A1. This document describes a container with a cap. The lid of the cap comprises two hooks, which, when the lid is closed, can protrude into the lower part thereof and latch at that position.

GB 2 082 552 A describes a child-proof container, which has an upper part which is provided with catch arms which lie against protrusions. The catch arms can be moved inwardly by means of a tab in order to release the upper part. A disadvantage of this design is that handling is not as simple as would be desired because the upper part cannot be grasped easily. Furthermore, the receiving space can only be inadequately sealed. This can lead to problems in the case of tablets being sensitive to moisture.

SUMMARY OF THE DISCLOSURE

A container with a child-proof lock is secure and simple to handle and can also be produced in a cost-effective manner. One non-limiting example of the container body comprises a container wall and forms a receiving space for goods to be packaged. The container comprises a discharge opening for discharging the goods to be packaged and a container closure for closing the discharge opening. The container closure comprises a lid which can assume a closed position, in which the lid closes the discharge opening, and the lid can be moved from the closed position to an open position in which the discharge opening is open. The container further comprises a child-proof lock, which includes a first locking element arranged on the lid, and a second locking element situated adjacent to the container. The second locking element is arranged outside of the container wall and at a radial distance from the container wall. The first and second locking elements cooperate with one another in a mutual locked position in which the lid is fixed in the closed position, and the first and second locking elements can be moved relative to each other from the locked position to a release position in which the lid can be moved to the open position. Such a container with the child-proof lock is particularly suitable for medicinal products, such as tablets. However, the container is equally suitable for other goods to be packaged, which need to be packaged in a particularly child-proof manner.

This design allows the container and child-proof lock to be handled in a particularly simple manner. By virtue of the second locking element being arranged outside of the container wall and at a radial distance therefrom, the child-proof lock can be designed such that this is simple and intuitive to operate for adults. Nevertheless, effective protection against being opened by children can be achieved. Furthermore, the container is suitable for securely packaging even sensitive goods to be packaged, such as tablets. The container can also be produced in a cost-effective manner.

In an advantageous embodiment of the invention, provision is made that a recess is provided on a side of the second locking element facing the container wall, in which the first locking element is at least partially received in the closed position of the lid. Such a recess can be arranged, for example, between the second locking element and the container wall. Such a design can be produced effectively and in a cost-effective manner and is also particularly simple to operate. In accordance with one development of this inventive concept, provision can be made that the container wall comprises an aperture in the region of the recess. Producability is also improved hereby.

In an advantageous manner, a projecting holding section is provided which extends outwardly from the container wall, wherein the second locking element is arranged on the holding section. The holding section can be arranged in particular on the container edge and can extend outwardly therefrom. In this manner, the second locking element can be arranged in a particularly favourable manner at a radial distance from the container wall.

In one non-limiting embodiment, the second locking element comprises a bar, which is attached to the holding section by means of a first connecting section. In this case, the bar can be connected to the container wall by means of a second connecting section. In an advantageous manner, the bar, holding section and container wall can thereby delimit the recess.

One non-limiting embodiment of the container further comprises a resilient tongue provided on the holding section, the actuating element being arranged on the resilient tongue. The resilient tongue can permit an easy actuation of the actuating element. Owing to the resilient properties of the resilient tongue, the actuating element can be moved to its actuating position and then automatically return to its rest position.

In a further improvement, provision is made that the actuating element comprises a contact surface, which is pressed against the first locking element in the actuating position. In this manner, the first locking element can be moved to the release position. In the rest position, the actuating element can be spaced apart from the first locking element. However, in the rest position, it can also lie against the first locking element with a low amount of force, wherein the first locking element is still located in the locked position. It is particularly preferred, if the contact surface faces the container wall. The actuating element can then be actuated by applying pressure from the outside to the inside.

A high level of safety and intuitive operation of the child-proof lock are achieved if a first locking element and a second locking element having an actuating element are provided in each case on two sides of the container. The first and second locking elements with their respective actuating element can be arranged in particular opposite each other, i.e. in a mirror-symmetrical manner with respect to a central plane of the container.

In an advantageous embodiment of the invention, provision is made that the container closure comprises a section situated adjacent to the container, which is arranged on the container body. In this manner, it is possible to produce the container closure as a separate part and then connect it to the container body. However, the section situated adjacent to the container can also be part of the container body.

In an advantageous manner, the section situated adjacent to the container is arranged on a container opening formed by the container wall. In this case, the discharge opening can be formed in the section situated adjacent to the container. It is particularly advantageous if the section situated adjacent to the container comprises an insert which is inserted into the container opening. Such a design is not only particularly easy and cost-effective to produce, but is also simple to operate.

Simple operability is achieved if the lid is movably articulated on the section situated adjacent to the container. Movable articulation can be achieved by a film hinge. Alternatively, the lid can also be movably articulated on the container wall.

In an advantageous manner, the first locking element is formed as a resiliently movable spring arm.

Good operability is also inter alia achieved by virtue of the fact that the first and second locking elements are formed as latching elements which latch together in the closed position of the lid.

Further objectives, features, advantages and possible applications of the present invention will be apparent from the description hereinafter of an exemplified embodiment with reference to the drawings. All of the described and/or figuratively illustrated features form the subject matter of the invention in their own right or in any meaningful combination, even irrespective of the combination in individual claims or dependency reference thereof.

DETAILED DESCRIPTION

Figure 1:
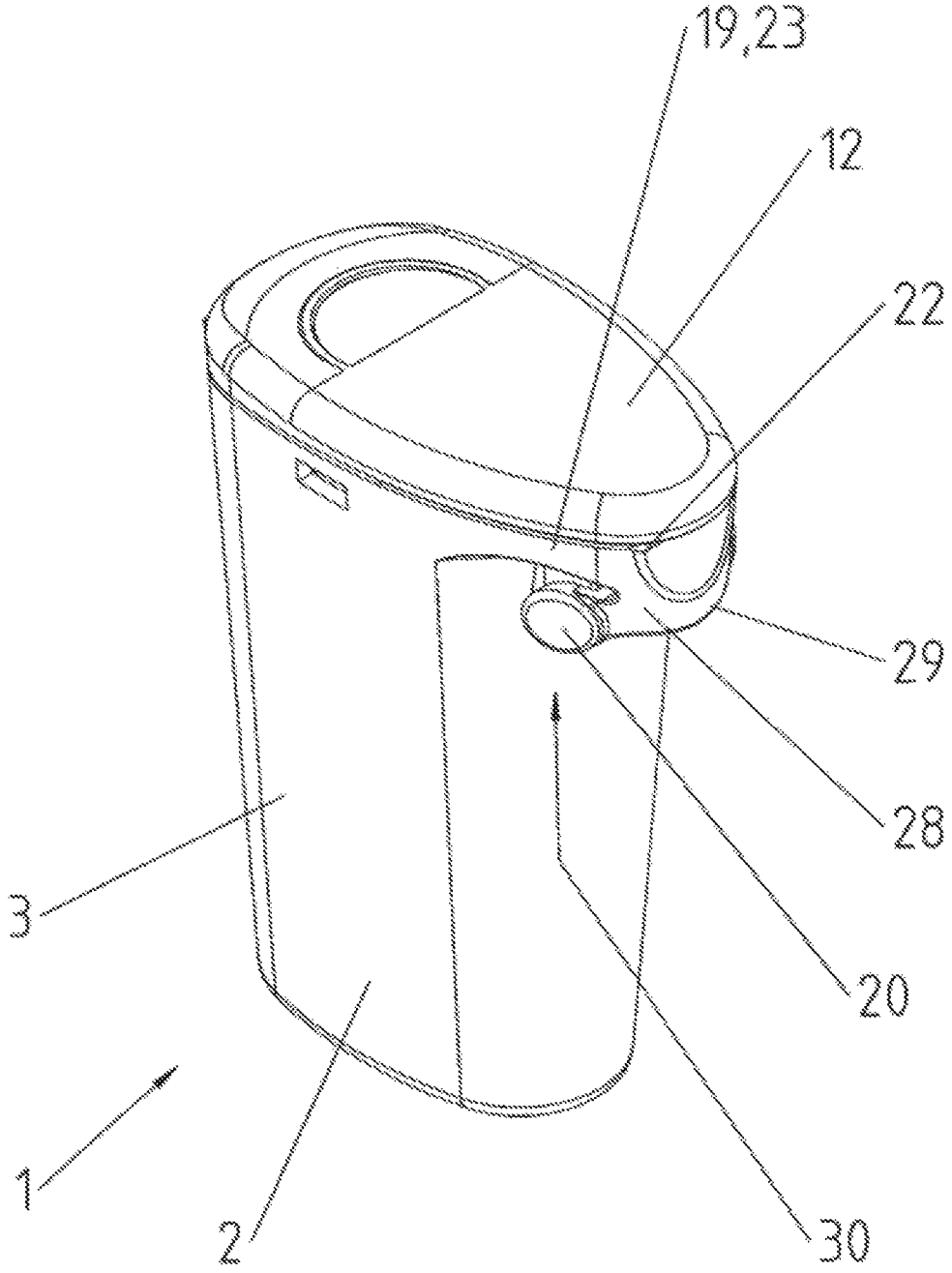
FIG. 1 shows a perspective view of one non-limiting embodiment of a container having a child-proof lock.

FIGS. 1 and 2A to 2E show a container 1, which comprises a container body 2 having a container wall 3. The container body 2 forms a receiving space 4 for goods to be packaged 5. This can be seen particularly clearly in the sectional view of FIG. 2C. The container is particularly suitable for goods to be packaged, which are in the form of tablets. It can, however, also be used for other goods to be packaged.

Figure 2A:
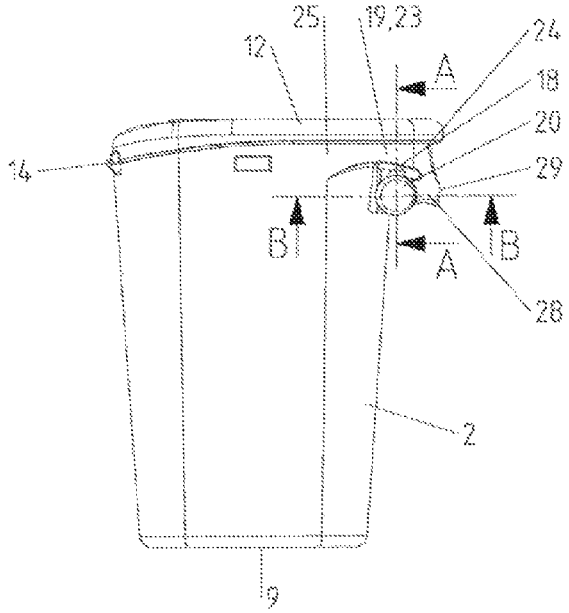
FIG. 2A shows a view of the longitudinal side of the container of FIG. 1.
Figure 2B:
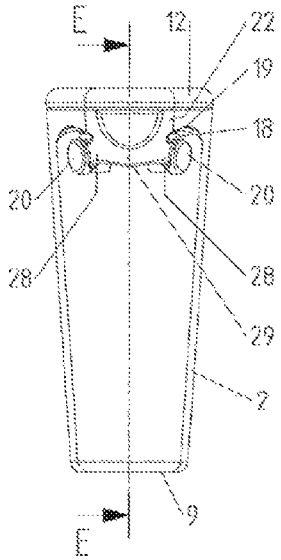
FIG. 2B shows a view of the transverse side of the container of FIG. 1.
Figure 2C:
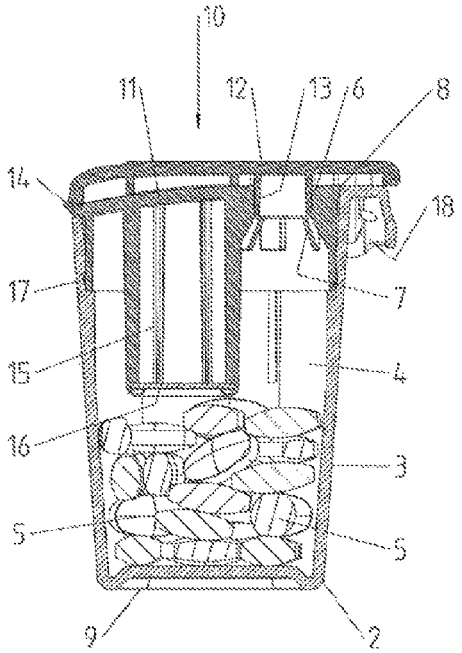
FIG. 2C shows a longitudinal section through the container of FIG. 2B along line E-E.
Figure 2D:
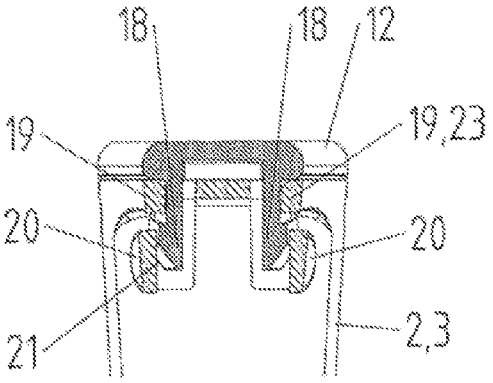
FIG. 2D shows a transverse section through a part of the container of FIG. 2A along line A-A.
Figure 2E:
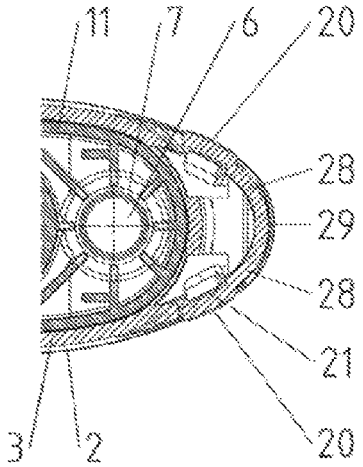
FIG. 2E shows a transverse section through a part of the container of FIG. 2A along line B-B.

FIGS. 2C and 2E clearly show that the container 1 comprises a discharge opening 6 for discharging the goods to be packaged 5. The discharge opening 6 is sized such that isolated goods to be packaged are discharged. This is achieved by virtue of the fact that the clear width of the discharge opening 6 is slightly larger than the smallest diameter of the goods to be packaged. Furthermore, a pouring aid 7 is provided on the discharge opening 6. This is formed by a region having a diameter, which tapers towards the discharge opening 6. In this respect, bars, which extend in an inclined manner are provided below the discharge opening 6. The discharging of individual tablets is facilitated by the pouring aid 7 and counteracts clogging in front of the discharge opening 6.

The container body 2 is designed in the form of a beaker. It comprises an upwardly facing container opening 8. The container wall 3 extends in an inclined manner from the base surface 9 and expands upwardly.

Furthermore, the container 1 comprises a container closure 10. In the illustrated exemplified embodiment, this closure has a section 11 situated adjacent to the container and a lid 12. The section 11 situated adjacent to the container is formed as an insert, which is inserted into the container opening 8. In the illustrated embodiment, the discharge opening 6 is arranged in the section 11 situated adjacent to the container. The discharge opening 6 is closed by the lid 12. In this respect, the lid comprises a protruding section 13, which protrudes into the discharge opening 6 and closes the same in a sealing manner in the closed position of the lid 12 illustrated in FIG. 2C. The lid 12 can be moved from the illustrated closed position to an open position in which the discharge opening is open. In the illustrated exemplified embodiment, the lid 12 is, in this respect, articulated on the section 11 situated adjacent to the container. In this respect, a film hinge 14 is provided which allows the lid 12 to move. In this manner, the container closure is formed as a flip-top closure.

Furthermore, the container closure 10 comprises a desiccant chamber 15. This is provided towards the receiving space 4 with a cover 16 made of moisture-permeable material, e.g. cardboard. A known desiccant can be accommodated in the desiccant chamber 15 in order to protect the goods to be packaged from moisture.

The section 11 situated adjacent to the container is formed as an insert, which is inserted into the container body 2. A seal 17 is provided in the connecting region between the container body 2 and section 11 situated adjacent to the container of the container closure 10. In the illustrated exemplified embodiment, this seal is formed as a circumferential sealing bead.

The container closure 10 comprises a child-proof lock 30 in order to protect the container 1 from unauthorized opening by children. In this respect, a first locking element 18 is provided on the lid. In the illustrated exemplified embodiment, this locking element is formed as a resiliently movable spring arm which extends downwards from the lid 12. A second locking element 19 is provided on the side situated adjacent to the container. A hook-like protrusion is formed on the first locking element 18 and engages behind the second locking element 19 in the closed position of the lid. In this manner, the first and second locking elements can latch together and assume a mutual locked position, in which the lid 12 is fixed in the closed position. The first and second locking elements 18, 19 can be moved relative to each other from the locked position to a release position, in which the lid 12 can be moved to the open position. In the illustrated exemplified embodiment, the first locking element 18 formed as a resilient spring arm can be moved, in this respect, inwardly towards the container body 1 until the hook-like protrusion is moved past the second locking element. In order to be able to operate the child-proof lock 30 simply and intuitively, an actuating element 20 is provided. This can be moved inwardly from the rest position illustrated in FIG. 2D to an actuating position in order to move the first locking element 18 from the locked position to the release position. In this respect, the actuating element 20 comprises a contact surface 21, which can be pressed against the first locking element. In the actuating position, the actuating element 20 is then pressed against the first locking element 18.

FIGS. 2B and 2E clearly show that the container 1 has two actuating elements 20, wherein first and second locking elements 18, 19 are allocated to each actuating element 20. The actuating elements 20 are arranged on opposite sides of the container 1. The actuating elements 20 can thus be pressed inwardly simply and at the same time, in order to simultaneously unlock the locking elements 18, 19.

FIGS. 1 and 2A to 2E also show that the second actuating element 19 is arranged outside of the container body 2 or container wall 3 and at a radial distance therefrom. In this respect, a holding section 22 is provided which is described in more detail in conjunction with the following figures. The first actuating element 18 is also arranged outside of the container body 2 at a radial distance therefrom.

In the further figures, the same parts are provided with the same reference signs as in FIG. 1. The corresponding description made in relation to FIGS. 1 and 2A to 2E applies accordingly.

Figure 3:
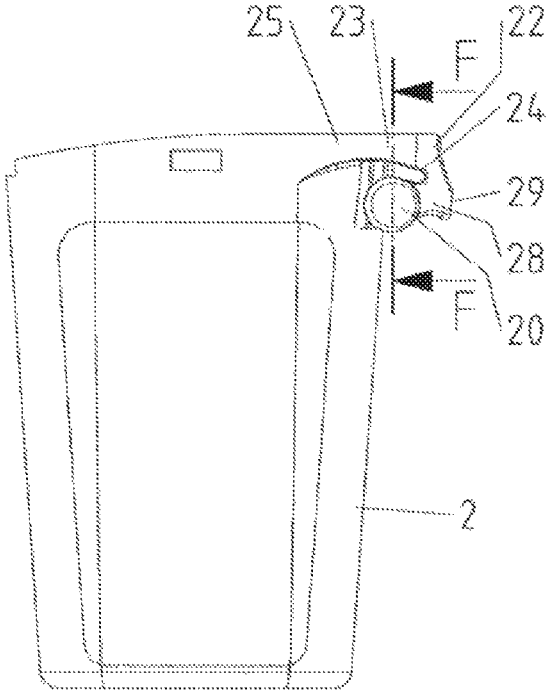
FIG. 3 shows a view of the longitudinal side of the container of FIG. 1, without a container closure.
Figure 4A:
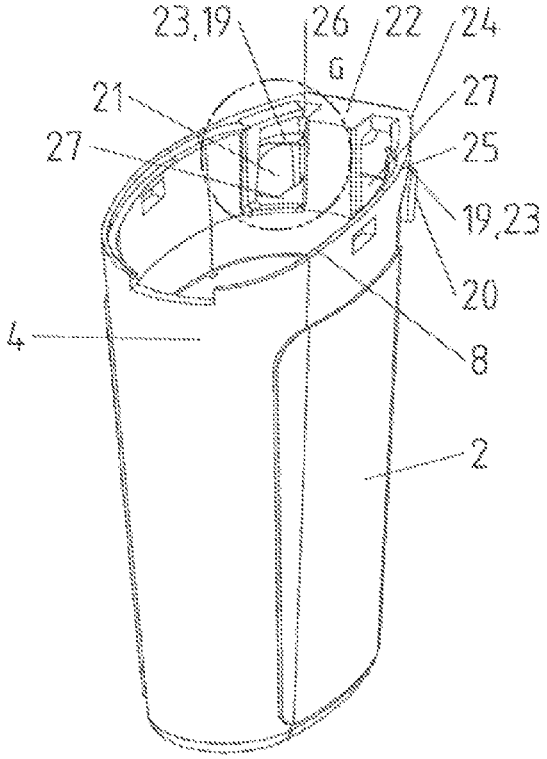
FIG. 4A shows a perspective view of the container of FIG. 3 from above.
Figure 4B:
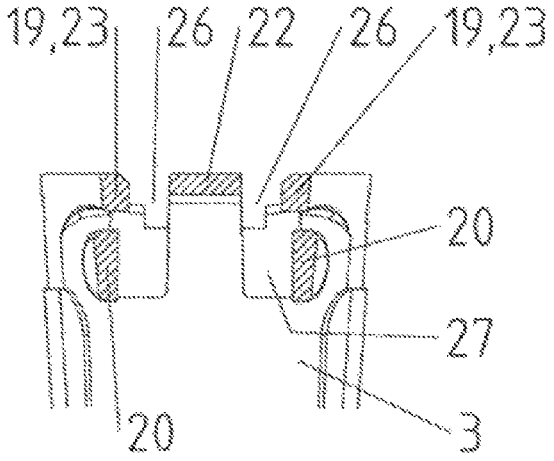
FIG. 4B shows a transverse section through a part of the container of FIG. 3 along line F-F.
Figure 4C:
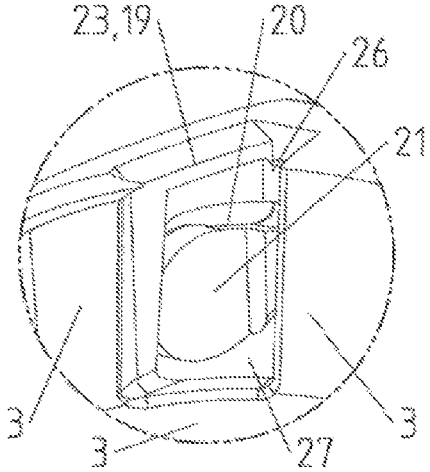
FIG. 4C shows an enlarged detail of the container of FIG. 4A.
Figure 5:
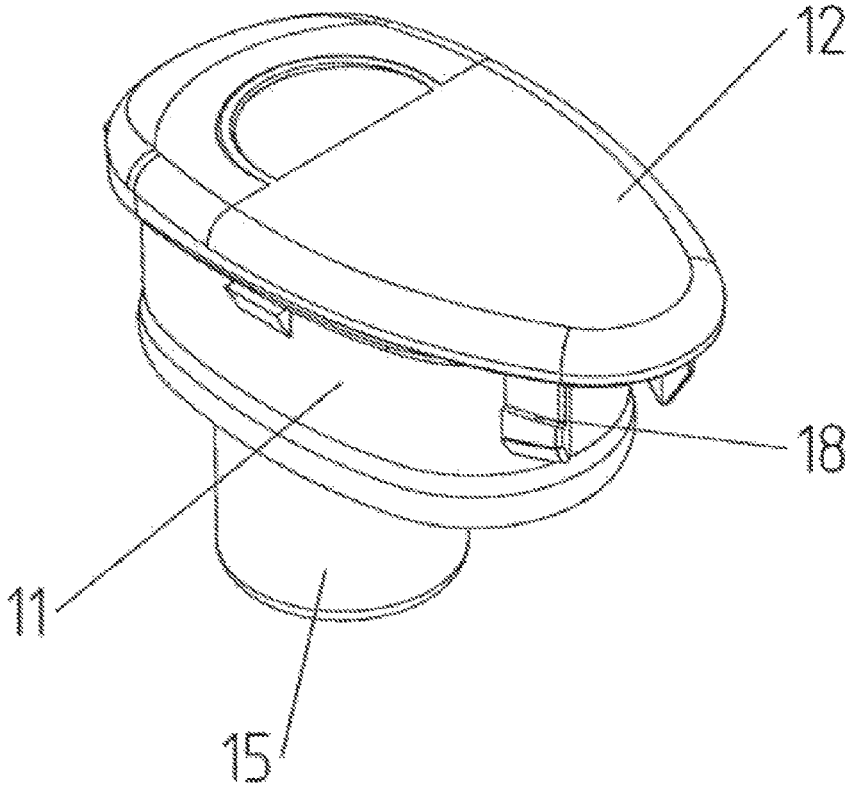
FIG. 5 shows a perspective view of the container closure of the container of FIG. 1 from above.
Figure 6A:
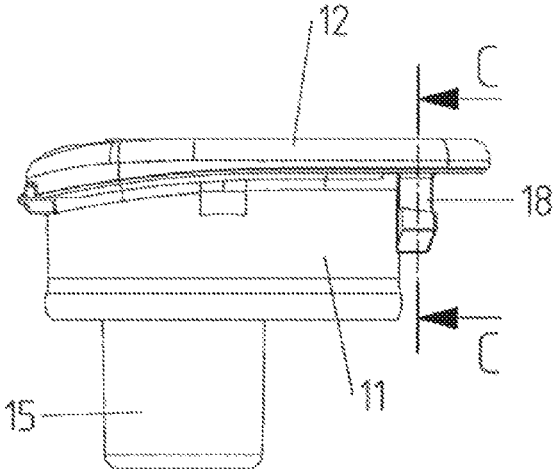
FIG. 6A shows a side view of the container closure of FIG. 5.
Figure 6B:
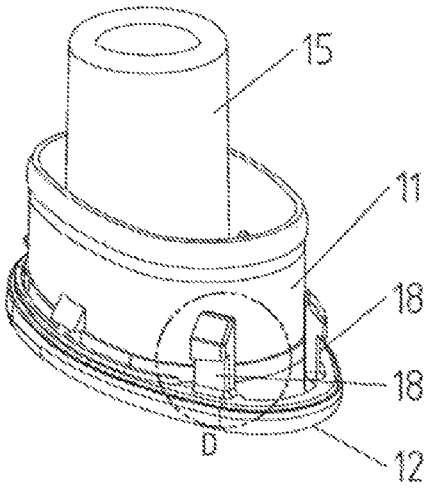
FIG. 6B shows a perspective view of the container closure of FIG. 5 from below.
Figure 6C:
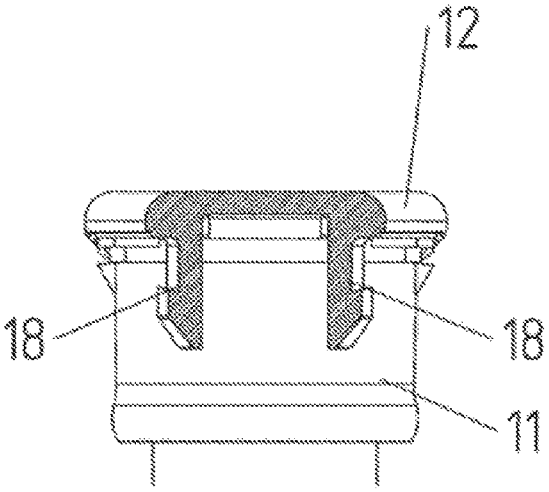
FIG. 6C shows a transverse section through a part of the container closure of FIG. 6A along line C-C.
Figure 6D:
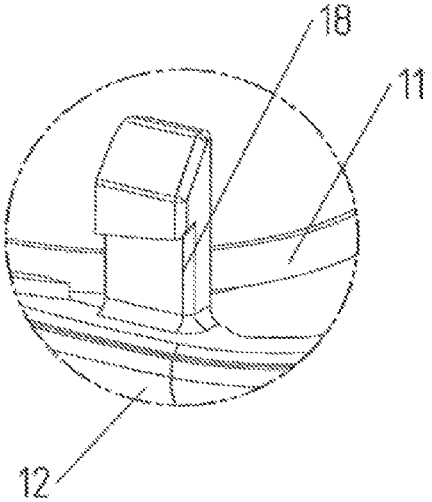
FIG. 6D shows an enlarged detail of the container closure of FIG. 6B.

FIGS. 3 and 4A to 4C show the container 1 without the container closure 10. The container body 2 which forms the receiving space 4 in its interior can again be clearly seen. In particular, FIG. 4A shows that the container body 2 has an oval cross-section in the illustrated exemplified embodiment.

FIGS. 3 and 4A clearly show the holding section 22. The holding section 22 is formed to be projecting and extends outwardly from the container wall 3. It allows in particular for the second locking element 19 to be arranged outside of the container body 2 and at a radial distance therefrom. The second locking element 19 is arranged on the holding section 22. In the illustrated exemplified embodiment, the second locking element 19 comprises a bar 23. The bar 23 is connected to the holding section 22 by means of a first connecting section 24. The bar 23 is connected to the container wall 3 via a second connecting section 25.

A recess 26 arranged outside of the container body 2 is provided on the side of the second locking element 19 facing the container wall 3. The first locking element 18 can be at least partially received in this recess in the closed position of the lid 12 in order to latch with the second locking element 19.

The container wall 3 comprises an aperture 27 in the region of the recess 26. The aperture 27 is arranged above the seal 17 (FIG. 4C) so that moisture cannot penetrate through the aperture 27 into the receiving space 4.

Furthermore, a resilient tongue 28 is provided on the holding section 22 for each actuating element 20. The resilient tongue 28 is resiliently movable so that the actuating element 20 can be pressed inwardly against the first locking element 18. Owing to the resilient properties of the resilient tongue 28, the actuating element 20 returns to its rest position when there is no more pressure on the actuating element.

In the illustrated embodiment, the actuating element 20 is formed as an actuating button. In the illustrated exemplified embodiment, this button has an approximately circular shape. The actuating elements 20 can thereby be easily grasped and compressed using two fingers. The contact surface 21 of the actuating element 20 faces inwards in each case.

The actuating elements 20 are arranged beneath the bars 23. The holding section 22 comprises a downwardly facing support section 29. The resilient tongues 28 are arranged on both sides of the support section. The resilient tongues 28 extend from the support section 29 towards the container body 2.

FIGS. 5 and 6A to 6D show the container closure 10 in detail. The design of the first locking elements 18, which are formed as resiliently movable spring arms, can be particularly seen herein.

The container 1 can most preferably be produced from synthetic material. The illustrated exemplified embodiment is formed as an injection moulded synthetic material part. The container 1 can be assembled from two injection moulded parts. The first injection moulded part comprises the container body 2 and the second injection moulded part comprises the section 11 situated adjacent to the container and the lid 12.

The invention claimed is:

1. A child-proof container comprising:

a container body, comprising a container wall and forming a receiving space for goods to be packaged therein, the container further comprising a discharge opening for discharging the goods therefrom;

a container closure for closing the discharge opening, wherein the container closure comprises a lid movable between a closed position, in which the lid closes the discharge opening, and an open position, in which the discharge opening is open; and a child-proof lock comprising a first locking element arranged on the lid co-operating with a second locking element situated adjacent to the container, wherein the first and second locking elements are moveable relative to one another between a locked position, in which the lid is fixed in the closed position, and a release position, in which the lid can be moved to the open position;

wherein the child-proof lock further comprises an actuating element that is movable from a rest position to an actuating position in order to move the first and second locking elements relative to each other from the locked position to the release position, wherein the second locking element is arranged outside of the container wall and at a radial distance from the container wall.

2. The child-proof container as claimed in claim 1, further comprising a recess on a side of the second locking element facing the container wall, the first locking element being at least partially received in the recess in the closed position of the lid.

3. The child-proof container as claimed in claim 2, wherein the container wall comprises an aperture in the region of the recess.

4. The child-proof container as claimed in claim 1, further comprising a projecting holding section which extends outwardly from the container wall, wherein the second locking element is arranged on the holding section.

5. The child-proof container as claimed in claim 4, wherein the second locking element comprises a bar which is attached to the holding section by means of a first connecting section.

6. The child-proof container as claimed in claim 5, wherein the bar is connected to the container wall by a second connecting section.

7. The child-proof container as claimed in claim 1, further comprising a resilient tongue provided on the holding section, the actuating element being arranged on the resilient tongue.

8. The child-proof container as claimed in claim 1, wherein the actuating element comprises a contact surface, which is pressed against the first locking element in the actuating position.

9. The child-proof container as claimed in claim 1, wherein each one of the first and second locking elements has the actuating element on a corresponding one of two sides of the container.

10. The child-proof container as claimed in claim 1, wherein the container closure comprises a section situated adjacent to the container which is arranged on the container body.

11. The child-proof container as claimed in claim 10, wherein the section situated adjacent to the container is arranged on a container opening formed by the container wall, wherein the discharge opening is formed in the section situated adjacent to the container.

12. The child-proof container as claimed in claim 10, wherein the lid is movably articulated on the section situated adjacent to the container.

13. The child-proof container as claimed in claim 1, wherein the first locking element is formed as a resiliently movable spring arm.

14. The child-proof container as claimed in claim 1, wherein the first and second locking elements are formed as latching elements which latch together in the closed position of the lid.

15. The child-proof container as claimed in claim 3, further comprising a projecting holding section which extends outwardly from the container wall, wherein the second locking element is arranged on the holding section.

16. The child-proof container as claimed in claim 15, further comprising a resilient tongue provided on the holding section, the actuating element being arranged on the resilient tongue.

17. The child-proof container as claimed in claim 16, wherein the actuating element comprises a contact surface, which is pressed against the first locking element in the actuating position.

18. The child-proof container as claimed in claim 16, wherein each one of the first and second locking elements has the actuating element on a corresponding one of two sides of the container.

19. The child-proof container as claimed in claim 3, wherein the actuating element comprises a contact surface, which is pressed against the first locking element in the actuating position.

20. The child-proof container as claimed in claim 3, wherein each one of the first and second locking elements has the actuating element on a corresponding one of two sides of the container.

* * * * *